US006067735A

United States Patent [19]

Kallenberger

[11] Patent Number: 6,067,735

[45] Date of Patent: May 30, 2000

[54] BOOM SUPPORT STRUCTURE FOR A HOIST ROPE SUPPORT SHEAVE

[75] Inventor: Harvey J. Kallenberger, Wind Lake, Wis.

[73] Assignee: Harnischfeger Technologies Inc., Wilmington, Del.

[21] Appl. No.: 09/199,968

[22] Filed: Nov. 25, 1998

[51] Int. Cl.[7] ..... E02F 5/02; E02F 9/14

[52] U.S. Cl. ..... 37/397; 254/398

[58] Field of Search ..... 37/397, 395, 394, 37/401; 254/398, 396, 397, 394

[56] References Cited

U.S. PATENT DOCUMENTS 3,829,992 8/1974 Reid et al. ..... 254/398
3,912,230 10/1975 Learmont ..... 37/397 X

*Primary Examiner*—Christopher J. Novosad
*Attorney, Agent, or Firm*—James Earl Lowe, Jr.

[57] ABSTRACT

A machine for heavy loads comprising a rope support sheave mounted on a boom between upper and lower ends of the boom for movement between a raised position wherein the sheave supports a hoist rope above the boom and a lowered position wherein the rope support sheave is accessible for maintenance.

20 Claims, 2 Drawing Sheets

BOOM SUPPORT STRUCTURE FOR A HOIST ROPE SUPPORT SHEAVE

BACKGROUND OF THE INVENTION

1. Field of the Invention

The invention is directed to machinery used for raising loads which include a boom and supporting structure. Examples of such machines include draglines and large industrial cranes.

2. Discussion of Prior Art

A walking dragline typically includes a main housing, a boom which extends upwardly and outwardly from the main housing, and a mast assembly which extends upwardly from the main housing for supporting the boom. The boom comprises a welded frame including longitudinally extending upper and lower pairs of chords and lacing welded between the chords. Support lines extend between the upper end of the mast assembly and the boom for supporting the boom relative to the mast assembly. A sheave mounted for rotation about a horizontal axis is on the upper end of the boom. Hoist ropes extend from a bucket hoist mechanism, over the sheave and then to a bucket. Extending or retracting the hoist ropes causes vertical movement of the bucket. A drag rope extends from a bucket drag mechanism to the bucket to permit horizontal movement of the bucket relative to the boom. The main housing is supported by a tub that sits on the ground when the dragline is engaged in digging operations. The main housing is supported for pivotal movement relative to the tub in a lateral plane about a vertical axis. A pair of walking mechanisms are mounted on opposite sides of the main housing and are operable for moving the main housing over the ground between digging operations. The main housing includes an operator's cab adjacent to and generally beneath the boom. A stairway extends from the inner end to the outer end of the boom.

Because the hoisting rope or ropes are quite heavy by virtue of their own dead weight, when these ropes become slack due to little or no load on them, the ropes can hit the top of the boom. To prevent this from happening, a rope support sheave is provided partway between the lower end and the upper end of the boom in order to prevent the hoist rope from hitting the boom.

When the hoisting rope is taut or under load and extends between the boom top sheave and the hoisting drum, the hoisting ropes are a substantial distance above the boom. As a result, the rope support sheave must be mounted a substantial distance above the boom. In the prior art, a rigid member structure was used to support the support sheave. This added substantial weight to the boom thus reducing the amount of weight which the boom could support. The rope support sheave requires regular maintenance due to the number of mechanical components involved with the sheave. In the prior art, additional access means such as ladders, stairs, platforms, etc. must be added to the boom in order to permit access to the rope support sheave for maintenance, which adds further weight to the boom, thus reducing the weight the boom can carry.

SUMMARY OF THE INVENTION

The invention provides a machine such as a dragline for lifting heavy loads, the machine comprising a main housing, a load hoist mechanism mounted on the housing, a boom having upper and lower ends, the lower end being connected to the main housing and the upper end having thereon a sheave mounted for rotation about a generally horizontal axis, the boom having a longitudinal axis and having two spaced apart top rails extending along the longitudinal axis, structure supporting the boom relative to the main housing, means for lifting a load, a hoist rope extending between the load lifting means and the load hoist mechanism and over the sheave to permit vertical movement of the load lifting means, a hoist rope support sheave, and means for mounting the rope support sheave on the top of the boom partway between the lower and upper ends of the boom, the mounting means comprising a first sheave support link pivotally connected to one of the boom rails and a second sheave support link pivotally connected to the other of the boom rails, the first and second sheave support links extending from the boom in an upright support position and having upper ends, a cross pin extending between the upper ends of the sheave support links, the hoist rope support sheave being rotatably mounted on the cross pin, and means for maintaining the support links in their upright support position and for pivoting the support links between their upright supporting position and a lowered maintenance position.

One of the primary features of the invention is to increase the amount of load a boom can carry by providing a lightweight sheave support structure.

It is another of the principal advantages of the invention to provide a rope support sheave which can be pivoted downwardly to limit the need for extra access structure to permit maintenance of the rope support sheave. This further reduces the extra weight added to the boom and increases its load carrying capabilities.

It is another of the principal advantages of the invention to provide a rope support sheave structure which is one-third to one-half the weight of the prior art structure but at comparable cost.

Other features and advantages of the invention will become apparent to those skilled in the art upon review of the following detailed description, claims and drawings.

Figure 1:
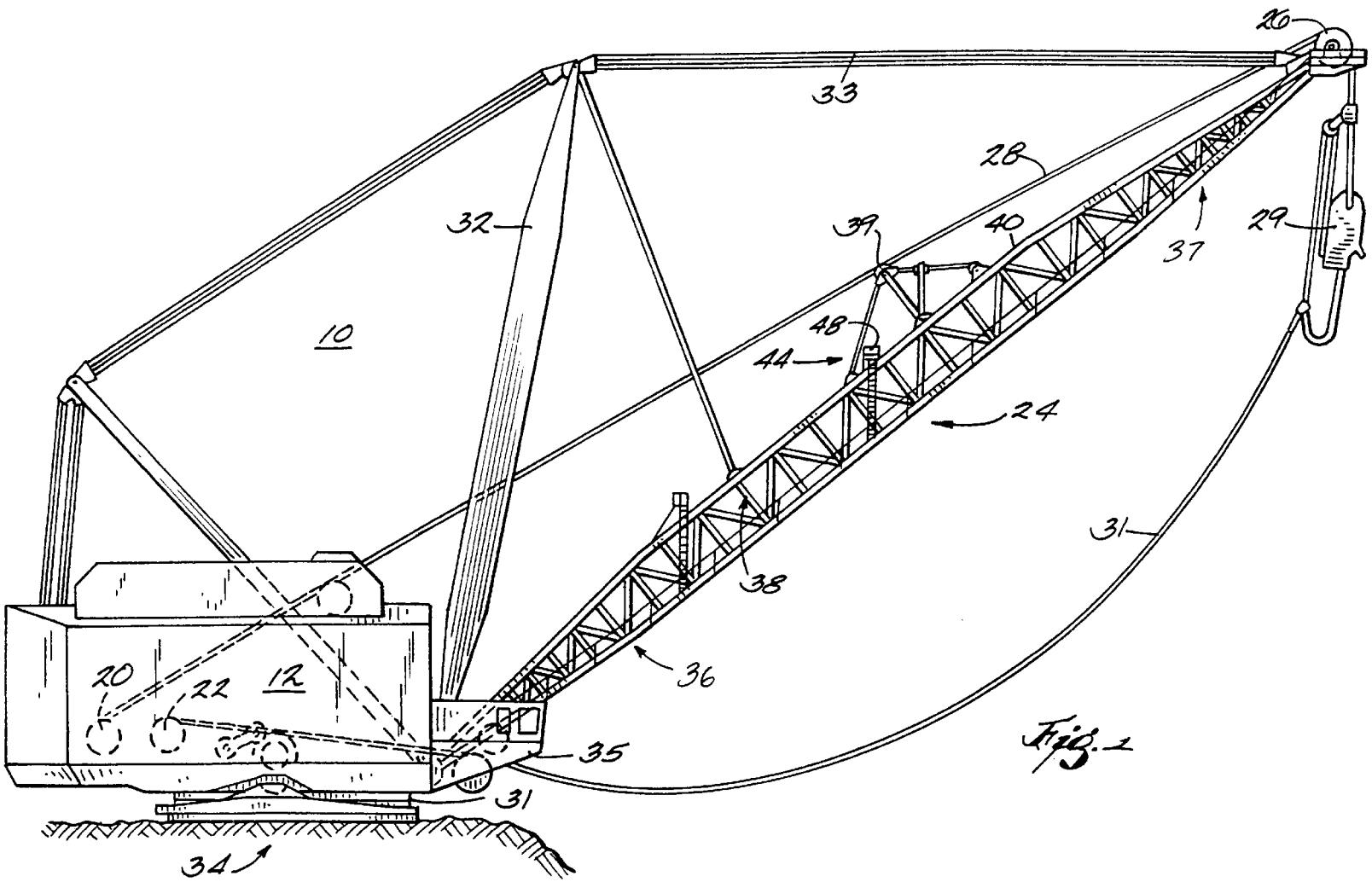
FIG. 1 is a side elevational view of a dragline embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof, as well as additional items. Use of "consisting of" and variations thereof as used herein is meant to encompass only the items listed thereafter and equivalents thereof.

DETAILED DESCRIPTION OF THE PREFERRED EMBODIMENT

The invention is directed to a machine for lifting heavy loads. One such machine is an industrial crane. In this embodiment, a walking dragline 10 embodying the invention is illustrated in the drawings. The dragline 10 comprises (see FIG. 1) a main housing 12. The dragline 10 also comprises a bucket hoist mechanism 20 and a bucket drag mechanism 22, both of which are mounted on the main housing 12. A boom 24 extends upwardly and outwardly from the main housing 12. The upper end of the boom 24 has thereon a sheave 26 which is rotatable about a horizontal axis. A hoist rope 28 extends between the bucket hoist mechanism 20 and over the sheave 26 to means for engaging or lifting a load, such as a bucket 29, to permit vertical movement of the bucket 29 relative to the boom 24. A drag rope 31 extends from the bucket drag mechanism 22 to the bucket 29 to permit horizontal movement of the bucket 29.

The boom 24 is supported relative to the main housing 12 by a conventional mast assembly 32. Support lines 33 are connected between the upper end of the mast assembly 32 and the boom 24 for supporting the boom 24 relative to the mast assembly 28. When the dragline 10 is digging, the main housing 12 is supported by a tub 31 that sits on the ground. The main housing 12 is supported for pivotal movement relative to the tub 31 in a lateral plane about a vertical axis. A pair of walking mechanisms 34 (one shown) move the main housing 12 over the ground between digging operations. The main housing 12 includes an operator's cab 35 adjacent to and generally below the boom 24. The dragline 10 as thus far described is conventional.

Referring to FIG. 1, the boom 24 includes a lower section 36, an upper section 37, and a center section 38 intermediate the lower and upper sections 36 and 37. In the illustrated embodiment, the boom 24 is rectangular in cross-section.

Because the hoisting rope or ropes 28 are quite heavy by virtue of their own dead weight, when these ropes become slack due to little or no load on them, the ropes 28 can hit the top section 37 of the boom 24. To prevent this from happening, a rope support sheave 39 is provided partway between the lower end and the upper end of the boom 24 in order to prevent the hoist rope 28 from hitting the boom 24. When the hoisting rope 28 is taut or under load and extends between the boom top sheave 26 and the hoisting drum 20, the hoisting rope 28 is a substantial distance above the boom 24. As a result, the rope support sheave 39 must be mounted a substantial distance above the boom 24.

Figure 2:
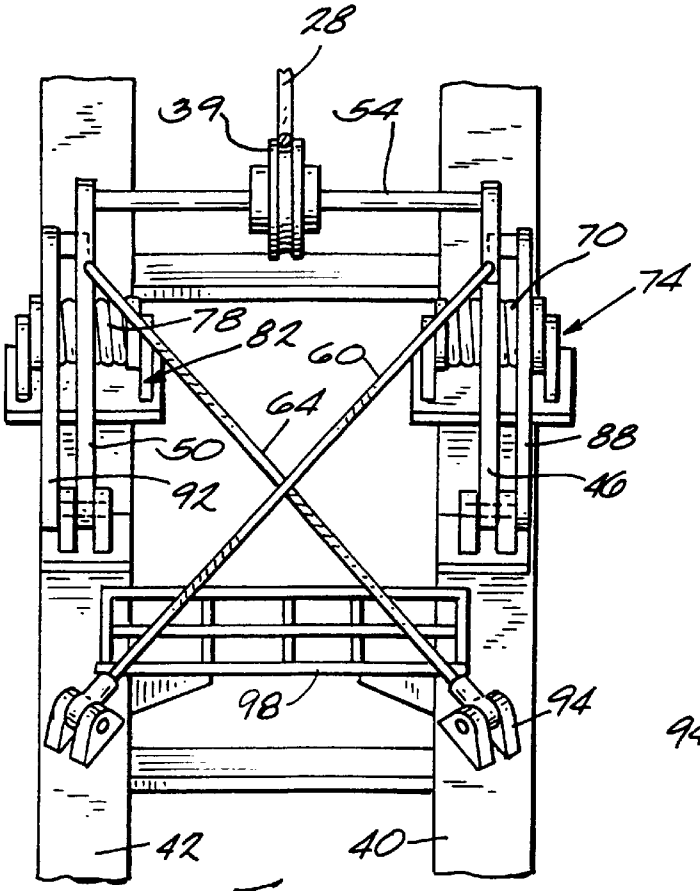
FIG. 2 is a top plan view of a rope support sheave structure on the boom.

Referring now to FIG. 2, the top of the boom 24 is formed from two parallel spaced apart chords or rails 40 and 42. The dragline 10 further includes means for mounting the rope support sheave 39 on the top of the boom 24, the mounting means or structure 44 comprising a first support link 46 pivotally connected to one rail 40 and a corresponding second support link 50 pivoted to the other boom rail 42. Extending between the upper ends of the support links is a cross pin 54. The rope support sheave 39 is slidably mounted upon the cross pin 54 and is free to rotate about the pin 54. Thus, when the hoist rope 28 is trained over the sheave 39, the sheave 39 can rotate as the rope 28 moves over the sheave 39 and, as the hoist rope 28 moves from left to right in FIG. 2 as it is paid out from the hoist drum 20, the sheave 39 can move back and forth along the cross pin 54 to limit the fleet angle of the hoist rope 28. In other embodiments, more than one rope support sheave 39 on the cross pin 54, as well as additional hoist ropes 28, can be used.

The sheave mounting structure 44 also includes means for maintaining the support links in their upright position and for pivoting the support links between their upright supporting position and a lowered maintenance position. The pivoting means comprises a first pivot rope 60 which extends between the upper end of the first support link 46 and the second boom rail 42 and a second pivot rope 64 attached to the other support link 50 and the first boom rail 40. In other embodiments (not shown), the pivot ropes 60 and 64 could be connected between the link and the rail which supports the support link.

Figure 3:
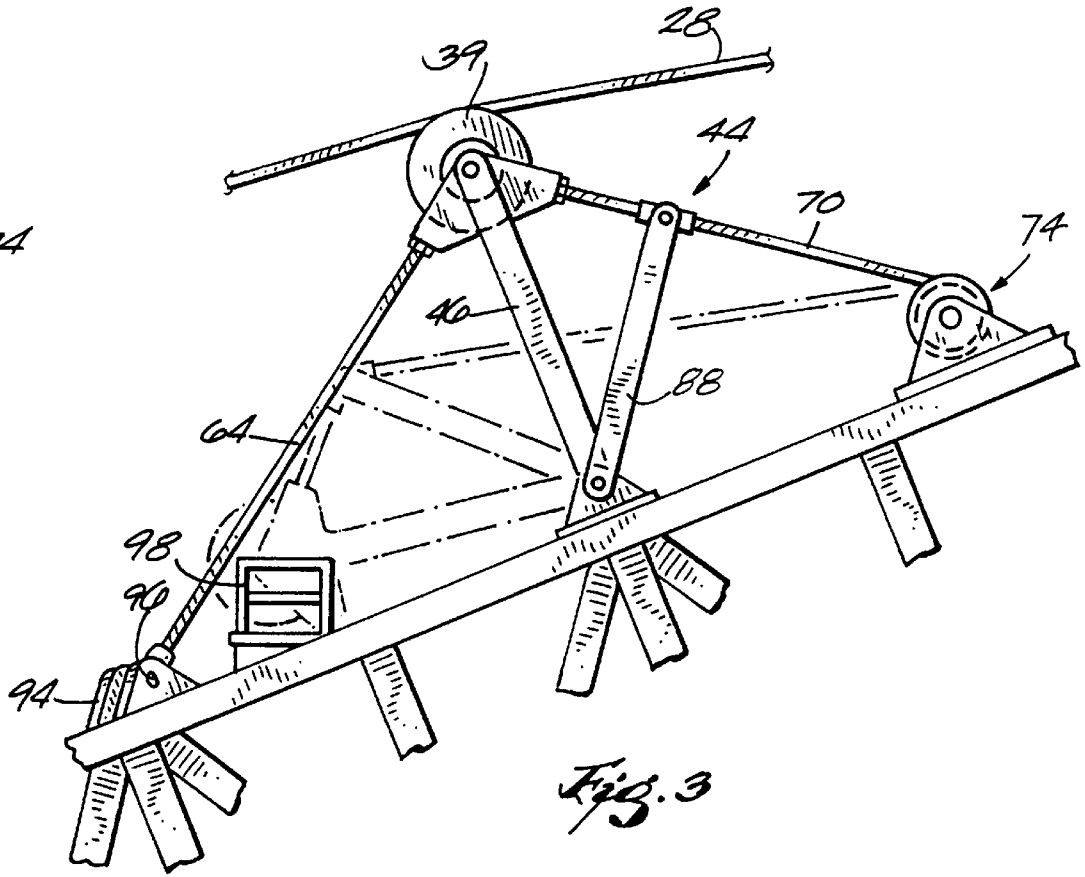
FIG. 3 is a side elevational view of the rope support sheave structure on the boom.

Each of the pivot ropes 60 and 64 is a fixed length between each of its respective support links and its boom rail and is flexible. Accordingly, when the support links 46 and 50 are pivoted from their upright position to their lowered maintenance position, the pivot ropes 60 and 64 flex and move out of the way. As the support links 46 and 50 are pivoted back to their upright position, clockwise as shown in FIG. 3, movement of the support links is limited by the ropes 60 and 64, and the ultimate position of the support links is determined by the fixed length of the pivot ropes 60 and 64.

The pivoting means further includes a first support rope 70 for holding the first support link 46 in its upright vertical position and for lowering the support link 46 to its maintenance position. The first support rope 70 is attached to the upper end of the support link 46 and at its other end to a first winch 74 mounted on the first boom rail 40. The winch 74 can pay out the support rope 70 in order to lower the rope support sheave 39 to its maintenance position (shown in ghost in FIG. 3) or the winch 74 can rotate in the other direction to raise the support link 46 and rope support sheave 39 to its vertical support position. A second support rope 78 (shown only in FIG. 2 because it is behind the rope 70 in FIG. 3) and a second winch 82 (behind winch 74 in FIG. 3) are provided in a comparable fashion for the second support link 50 on the second boom rail. Winches 74 and 82 operate together. In other embodiments, other support rope arrangements can be used. For example, a single support rope on a rail (not shown) extending across the boom rails could also be used.

In the preferred embodiment, the pivoting means further includes a first pivot link 88 fixed at one end to the support rope 70 and pivotally mounted at its other end to the boom rail 40 at the lower end of the support link 46. A comparable second pivot link 92 (shown only in FIG. 2) is also mounted on the other boom rail 42. The pivot links aid in the raising and lowering of the support links. In other embodiments, the pivot links can be omitted. Each of the links and ropes is pivotally mounted to its respective support rail by spaced apart lugs 94 and a pin 96 which extends between the lugs and through openings in the respective link or rope member.

In operation, a maintenance operator will operate the winches 74 and 82 in order to pay out the support ropes and lower the rope support sheave 39 to a platform 98 which extends between the spaced apart boom rails 40 and 42. With the sheave 39 at the platform 98, maintenance on the sheave can be undertaken.

High strength structural strand or wire rope can be used for both the pivot ropes and the support ropes. The combination of the use of structural strand or wire rope and less maintenance structure reduces the weight of the support sheave structure by one-third to one-half of the prior art weight, while keeping the cost of the sheave support structure about the same.

Various features of the invention are set forth in the following claims.

I claim:

1. A machine for lifting heavy loads, the machine comprising a main housing, a load hoist mechanism mounted on said housing, a boom having upper and lower ends, said lower end being connected to said main housing and said upper end having thereon a sheave mounted for rotation about a generally horizontal axis, said boom having a longitudinal axis and having a first boom top rail and a second boom top rail spaced apart from said first boom rail, both rails extending along said longitudinal axis, structure supporting said boom relative to said main housing, means for lifting a load, a hoist rope extending between said load lifting means and said load hoist mechanism and over said sheave to permit vertical movement of said load lifting means, a hoist rope support sheave, and means for mounting said rope support sheave on the top of said boom partway between the lower and upper ends of said boom, said mounting means comprising a first sheave support link pivotally connected to said first boom rail, a second sheave support link pivotally connected to said second boom rail, said first and second sheave support links extending from said boom in an upright support position and having upper ends, a cross pin extending between the upper ends of said sheave support links, said hoist rope support sheave being rotatably mounted on said cross pin, and means for maintaining said support links in their upright support position and for pivoting said support links between their upright supporting position and a lowered maintenance position.

2. A machine according to claim 1 wherein said means for maintaining the support links in their upright position and for pivoting the support links between their upright supporting position and a lowered maintenance position comprises a first pivot rope which is attached to the upper end of said first support link and to one of the boom rails and a second pivot rope which is attached to the upper end of said second support link and to the other of said boom rails.

3. A machine according to claim 2 wherein said first pivot rope is attached to the second boom rail and said second pivot rope is attached to said first boom rail.

4. A machine according to claim 2 wherein said first and second pivot ropes are a fixed length between each of its respective support links and its boom rail and are flexible.

5. A machine according to claim 2 wherein said pivoting means further includes a first support rope for holding the first support link in its upright vertical position and for lowering the support link to its maintenance position, said first support rope being attached at one end to the upper end of the first support link and at its other end to a first winch mounted on the first boom rail.

6. A machine according to claim 5 wherein said pivoting means further includes a second support rope for holding the second support link in its upright vertical position and for lowering the second support link to its maintenance position, said second support rope being attached at one end to the upper end of the second support link and at its other end to a second winch mounted on the second boom rail.

7. A machine according to claim 6 wherein said pivoting means further includes a first pivot link fixed at one end to the first support rope and pivotally mounted at its other end to the first boom rail and a second pivot link fixed at one end to the second support rope and pivotally mounted at its other end to the second boom rail.

8. A machine according to claim 1 wherein said machine further includes a platform which extends between the spaced apart boom rails.

9. A dragline comprising a main housing, a bucket hoist mechanism mounted on said housing, a bucket drag mechanism mounted on said main housing, a moving mechanism for moving said main housing over the ground, a boom having upper and lower ends and a rectangular cross-section, said lower end being connected to said main housing, said upper end having thereon a sheave, said boom having a longitudinal axis, said sheave being mounted for rotation about a generally horizontal upper axis, said boom having a first boom top rail and a second boom top rail spaced apart from said first boom rail, both rails extending along said longitudinal axis, structure supporting said boom relative to said main housing, means for lifting a load, a hoist rope extending between said load lifting means and said load hoist mechanism and over said sheave to permit vertical movement of said load lifting means, a hoist rope support sheave, and means for mounting said rope support sheave on the top of said boom partway between the lower and upper ends of said boom, said mounting means comprising a first sheave support link pivotally connected to said first boom rail, a second sheave support link pivotally connected to said second boom rail, said first and second sheave support links extending from said boom in an upright support position and having upper ends, a cross pin extending between the upper ends of said sheave support links, said hoist rope support sheave being rotatably mounted on said cross pin, and means for maintaining said support links in their upright support position and for pivoting said support links between their upright supporting position and a lowered maintenance position.

10. A dragline according to claim 9 wherein said means for maintaining the support links in their upright position and for pivoting the support links between their upright supporting position and a lowered maintenance position comprises a first pivot rope which is attached to the upper end of said first support link and to one of the boom rails and a second pivot rope which is attached to the upper end of said second support link and to the other of said boom rails.

11. A dragline according to claim 10 wherein said first pivot rope is attached to the opposite second boom rail and said second pivot rope is attached to said first boom rail.

12. A dragline according to claim 10 wherein said first and second pivot ropes are a fixed length between each of its respective support links and its boom rail and are flexible.

13. A dragline according to claim 10 wherein said pivoting means further includes a first support rope for holding the first support link in its upright vertical position and for lowering the support link to its maintenance position, said first support rope being attached at one end to the upper end of the first support link and at its other end to a first winch mounted on the first boom rail.

14. A dragline according to claim 13 wherein said pivoting means further includes a second support rope for holding the second support link in its upright vertical position and for lowering the second support link to its maintenance position, said second support rope being attached at one end to the upper end of the second support link and at its other end to a second winch mounted on the second boom rail.

15. A dragline according to claim 14 wherein said mounting means further includes a first pivot link fixed at one end to the first support rope and pivotally mounted at its other end to the first boom rail and a second pivot link fixed at one end to the second support rope and pivotally mounted at its other end to the second boom rail.

16. A dragline according to claim 9 wherein said dragline further includes a platform which extends between the spaced apart boom rails.

17. A machine for lifting heavy loads, the machine comprising a main housing, a load hoist mechanism mounted on said housing, a boom having upper and lower ends, said lower end being connected to said main housing and said upper end having thereon a sheave mounted for rotation about a horizontal axis, structure supporting said boom relative to said main housing, means for engaging a load, a hoist rope extending between said load engaging means and said load hoist mechanism and over said sheave to permit vertical movement of said load engaging means, and a rope support sheave mounted on said boom between said upper and lower ends of said boom for movement between a raised position wherein said sheave supports said hoist rope above said boom and a lowered position wherein said rope support sheave is accessible for maintenance.

18. A machine as set forth in claim 17 and further comprising a link mounted on said boom for pivotal movement relative thereto between raised and lowered positions corresponding to said raised and lowered positions of said rope support sheave, and wherein said rope support sheave is pivotally mounted on said link.

19. A machine as set forth in claim 17 and further comprising first and second links mounted on said boom for pivotal movement relative thereto between respective raised and lowered positions corresponding to said raised and lowered positions of said rope support sheave, and a cross pin extending between said first and second links, and wherein said rope support sheave is pivotally mounted on said cross pin.

20. A machine as set forth in claim 19 and further comprising means for selectively moving said links between said raised and lowered positions and for selectively maintaining said links in said raised positions.

* * * * *